US005720220A

United States Patent [19]

Kodama et al.

[11] Patent Number: 5,720,220

[45] Date of Patent: Feb. 24, 1998

[54] STENCIL PRINTING APPARATUS

[75] Inventors: Kengo Kodama; Hideaki Yamagishi, both of Inashiki-gun, Japan

[73] Assignee: Riso Kagaku Corporation, Tokyo, Japan

[21] Appl. No.: 638,046

[22] Filed: Apr. 26, 1996

[30] Foreign Application Priority Data

Apr. 28, 1995 [JP] Japan ..... 7-105606

[51] Int. Cl.[6] ..... B05C 17/06; B41C 1/14

[52] U.S. Cl. ..... 101/127.1; 101/128.4

[58] Field of Search ..... 101/128.1, 127.1, 101/128, 126, 128.4

[56] References Cited

U.S. PATENT DOCUMENTS 2,436,882 3/1948 Edelhart .

5,138,943 8/1992 Kikuchi et al. ..... 101/115

FOREIGN PATENT DOCUMENTS 58-133455 9/1983 Japan .

2-41099 1/1992 Japan ..... 101/126

*Primary Examiner*—Edgar S. Burr

*Assistant Examiner*—Dave A. Ghatt

*Attorney, Agent, or Firm*—Kanesaka & Takeuchi

[57] ABSTRACT

A stencil printing apparatus includes a base on which a original is set during a perforating operation and an item to be printed is set during a printing operation, a pressing member pivotaly attached to one end of the base and having a mounting device for mounting a stencil sheet on a plane facing the base, and a supporting device arranged to project near the mounting device at the pressing member and supporting a part of peripheral edges of the engaged stencil sheet.

9 Claims, 6 Drawing Sheets

STENCIL PRINTING APPARATUS

BACKGROUND OF THE INVENTION

This invention relates to a stencil printing apparatus in which a heatsensitive perforating and a stencil printing are carried out by one unit of printing device, and more particularly a stencil printing apparatus capable of performing both making of a perforated plate and printing by using the perforated plate well.

FIG. 10 is a perspective view for showing a stencil printing apparatus.

This device is comprised of substantially a base 1, a pressing plate 2 which can be rotated against the base 1 and a light radiating device 3 which can be freely set to or removed from the pressing plate 2.

A making of a perforated plate is carried out such that the light radiating device 3 and a stencil sheet 5 are attached at the side of the pressing plate 2 and the pressing plate 2 is pushed against the base 1 while the original is being placed on the base seat 4 of the base 1.

In addition, printing is carried out similarly by a method wherein the pressing plate 2 is pushed against the item to be placed on the base seat 4 while printing ink is included or applied in the stencil sheet 5.

The stencil sheet 5 has a frame member 5*a* of which circumference is formed by a hard sheet of paper and the like and in the case of performing the making of a perforated plate and printing operation, the sheet is engaged with and held by guides 6a on the transparent plate 8 arranged at a plane of the pressing plate 2 facing the base 1.

However, when the stencil sheet 5 is set or removed, the stencil sheet 5 sometimes scratches the transparent plate 8 to make scar on it. The transparent plate 8 in the device disclosed in the gazette of Japanese Utility Model Laid-Open No. Sho 58-133455 was constructed such that light radiated from the light radiating device 3 passes through the transparent member to make a perforated plate by the heat sensitive stencil sheet 5, so that if the transparent plate 8 was scarred, this scar might cause a lack of radiation of light beam to be generated and a poor perforated part was sometimes generated at the same location in the stencil sheet 5.

Upon application of the stencil sheet 5 having a poor perforated plate, irregular printing such as blur may be produced at the same location also during the printing operation.

SUMMARY OF THE INVENTION

The present invention has been completed in order to solve the aforesaid problem, wherein it is an object of the present invention to provide a stencil printing apparatus in which the transparent plate is not scarred or damaged when the stencil sheet is set to or removed from the device, a poor perforated plate caused by this damaged can be prevented and a printing quality can be improved.

A stencil printing apparatus according to a first aspect of the invention is comprised of a base on which an original is set during a perforating operation and an item to be printed is set during a printing operation, a pressing member pivotaly attached to one end of the base and having mounting means for mounting a stencil sheet on a plane facing the base, and supporting means arranged to project near the mounting means at the pressing member and supporting a part of peripheral edges of the stencil sheet.

A stencil printing apparatus according to a second aspect of the invention is comprised of a base on which an original is set during a perforating operation and an item to be printed is set during a printing operation; a pressing member pivotaly attached to one end of the base and having a through-pass opening formed therein; a transparent pressing plate arranged at the opening of the pressing member facing against the base; mounting means arranged at the pressing plate facing the base, contacted with the peripheral edges of a stencil sheet facing the base and engaged with the stencil sheet; and supporting means placed at a position inside said mounting means and outside a printable region of said stencil sheet engaged with said mounting means, and formed in said pressing plate facing said base. The supporting means is arranged along said mounting means and projects toward said stencil sheet engaged with said mounting means.

A stencil printing apparatus according to a third aspect of the invention is made such that the mounting means in the stencil printing apparatus of the second aspect are formed along a setting direction of the stencil sheet.

A stencil printing apparatus according to a fourth aspect of the invention is made such that the mounting means in the stencil printing apparatus of the third aspect are engaged with both sides in parallel with a setting direction of the stencil sheet.

A stencil printing apparatus according to a fifth aspect of the invention is made such that the supporting means in the stencil printing apparatus of the second aspect are projections formed along a setting direction of the stencil sheet.

A stencil printing apparatus according to a sixth aspect of the invention is made such that the supporting means in the stencil printing apparatus of the fifth aspect are contacted with both sides of the stencil sheet in parallel with a setting direction of the stencil sheet.

A stencil printing apparatus according to a seventh aspect of the invention is made such that the supporting means in the stencil printing apparatus of the sixth aspect have inclined surfaces with a predetermined angle at sides facing the mounting means.

A stencil printing apparatus according to an eighth aspect of the invention is made such that the ends of the supporting means in the stencil printing apparatus of the sixth aspect are gradually changed in height from the pressing plate.

A stencil printing apparatus according to a ninth aspect of the invention is made such that a space from a contact position between the supporting means and the stencil sheet to a contact position between the mounting means and the stencil sheet in the stencil printing apparatus of claim 2 is set to be substantially equal to or more than a thickness of the stencil sheet.

In the case that the stencil sheet is set or removed along the mounting means, the outermost parts of the peripheral edges of the stencil sheet are pressed by the mounting means, and portions slightly inside the outermost parts are slightly lifted up by the supporting members from the pressing plate.

With such an arrangement as above, the stencil sheet is warped toward the base to generate a clearance between itself and the surface of the pressing plate. The sheet does not substantially contact the pressing plate and does not scratch the pressing plate. The perforating process can be performed well.

In addition, during the printing operation, since the stencil sheet is curved by the supporting members toward the item to be printed, the stencil sheet is positively contacted with the item to be printed and the damage in an image can be prevented.

DESCRIPTION OF THE PREFERRED EMBODIMENT

Figure 1:
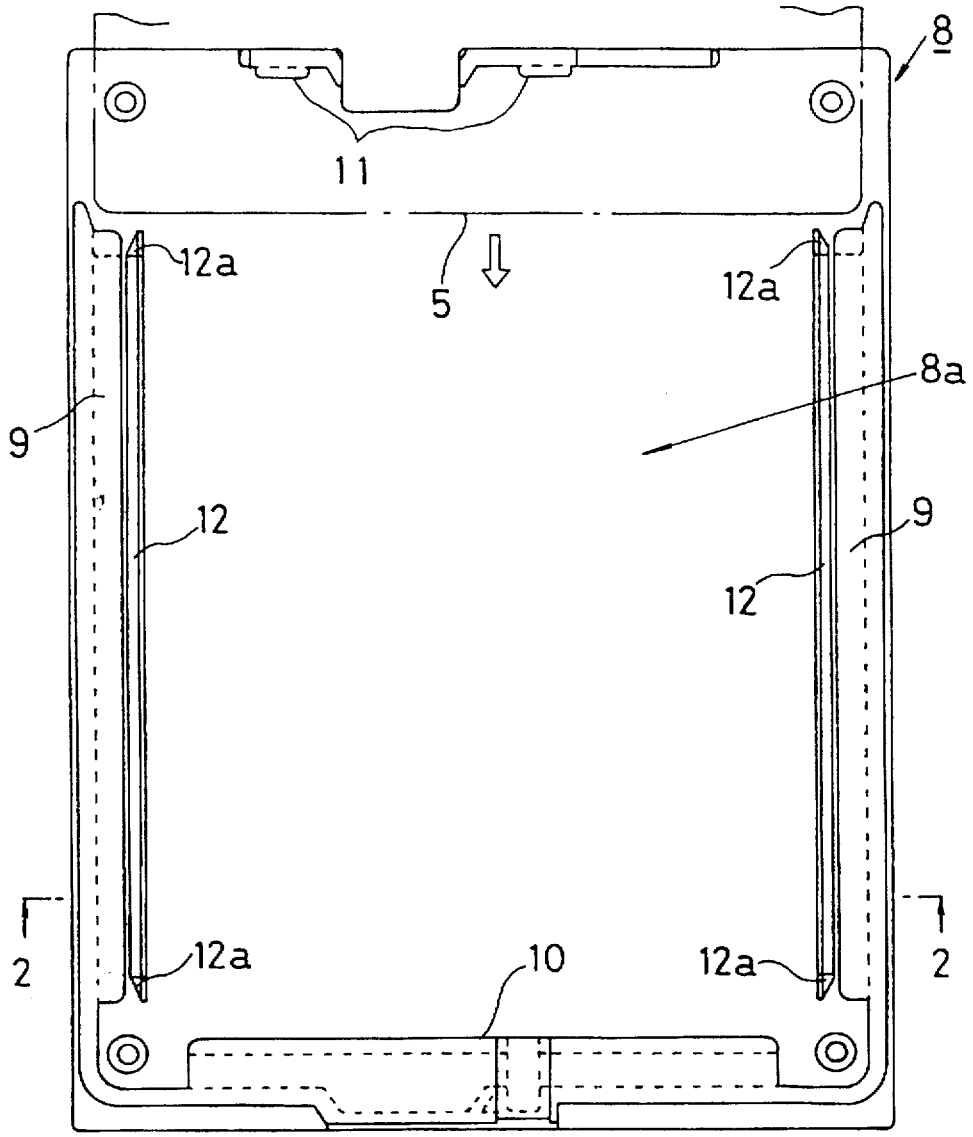
FIG. 1 is a top plan view for showing a transparent plate to be used in a stencil printing device.
Figure 2:
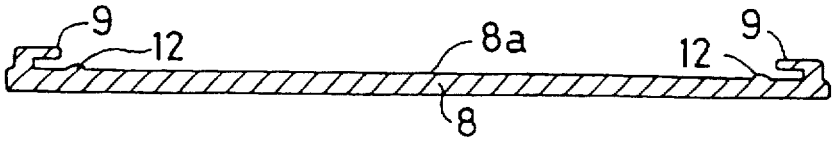
FIG. 2 is a sectional view taken along a line 2—2 of FIG. 1.

FIG. 1 is a top plan view for showing a transparent plate to be used in a stencil printing apparatus of one preferred embodiment of the present invention. FIG. 2 is a sectional view taken along a line 2—2 of FIG. 1. In these figures, the same elements as those of the prior art are denoted by the same reference numbers.

A transparent pressing flat plane (a transparent plate) 8 having a predetermined thickness is formed by synthetic resin and the like. This transparent plate 8 is arranged at a side of the pressing plate 2 of the device, i.e. at a plane facing the base seat 4 on the base 1. This transparent plate 8 is formed to have a larger size than a width and a length of the stencil sheet so as to engage with and hold the stencil sheet.

Engaging means (side guides) 9 projecting from a plane 8*a* of the transparent plate 8 are arranged continuously at both sides of the transparent plate 8 over a predetermined length.

Each of the side guides 9 is bent oppositely from each other and formed into an L-shape, and both sides of a stencil sheet 5 inserted from the upper part shown in FIG. 1 into these opposite guides 9, 9 are engaged and held while they are being guided.

A stopper guide 10 is similarly arranged at a front end (a lower part as viewed in this figure) in an inserting or setting direction (indicated by an arrow) of the stencil sheet 5 so as to engage with and hold the front end of the stencil sheet 5.

Thus, the stencil sheet 5 is engaged and held at a total number of four locations of a pair of side guides 9, the stopper guide 10 and a holding guide 11 arranged at a position facing the stopper guide 10.

Figure 3:
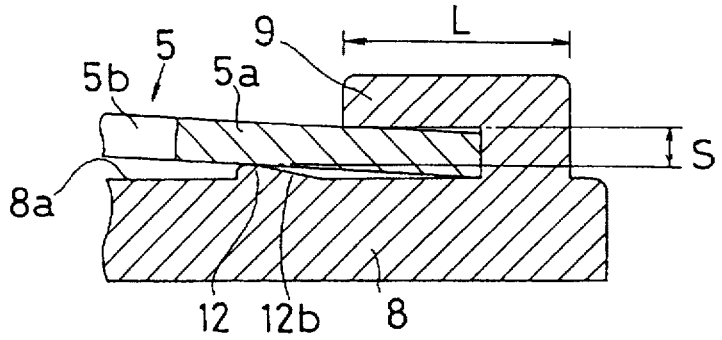
FIG. 3 is a partial sectional view for showing a side guide.

FIG. 3 is a partial sectional view for showing the side guide 9.

A width L of the side guide 9 is set to be a length where it is contacted with a frame part 5*a* of the stencil sheet 5 and located more outside than a printing-enabled region (a perforating/printing plane) 5*b*.

As shown in FIG. 1, supporting means (ribs) 12 in parallel with the side guides 9 are formed to project continuously on the plane 8*a* of the transparent plate 8 and are spaced from the end surface positions of the side guides 9 to their inner sides (for example, a height of 0.5 mm). Each of both ends 12*a* of the ribs 12 is formed into a tapered shape to gradually project from above the plane 8*a* without any step.

As shown in FIG. 3, the rib 12 is formed with a slant surface 12*b* having a predetermined angle directed toward the side guide 9.

A clearance S between the upper surface of the rib 12 and the lower surface of the guide 9 is formed to be equal to a thickness of the stencil sheet 5 or slightly larger than that.

More practically, when a thickness of the frame member 5*a* of the stencil sheet 5 is 1.3 mm, the clearance S is 1.5 mm.

Then, installing of the stencil sheet 5 having the aforesaid configuration is carried out such that as shown in FIG. 1, the stencil sheet 5 is inserted between the side guides 9, 9.

Each of both sides of the stencil sheet 5 is guided by the side guide 9 and advances in a longitudinal direction of the device.

Figure 4:
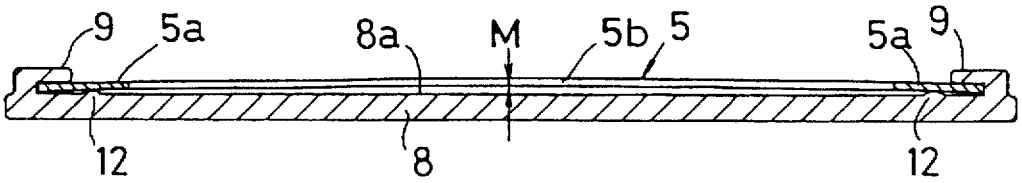
FIG. 4 is a sectional view for showing a setting state of a stencil sheet.

At this time, as shown in the operational diagram of FIG. 4, the stencil sheet 5 is lifted up at its inner position from both side edges and this stencil sheet 5 is warped like a pot-belly shape. With such an arrangement as above, the stencil sheet 5 advances while the central part 5*b* of the stencil printing surface of the stencil sheet 5 forms a clearance M spaced apart from the plane 8*a* of the transparent plate 8.

Thus, the stencil sheet 5 does not contact the transparent plate 8 when installed and does not scratch the transparent plate 8. Accordingly, even in the case that the light radiating device 3 is operated to perforate an original image onto the stencil sheet 5, it can be perforated under a state in which no scar is produced on the transparent plate 8, resulting in that the perforating can be performed well.

Upon completion of formation of the perforated plate, when the stencil sheet 5 is removed from the pressing plate 2, the ribs 12 may form the clearance M between the stencil sheet 5 and the transparent plate 8, so that the transparent plate 8 may not be damaged also when its removing operation is carried out.

In addition, in the case that the ribs 12 are provided with slant surfaces 12*b*, setting or removing of the stencil sheet 5 can be easily carried out against the side guides 9, the stencil sheet 5 is entirely warped along the slant surfaces 12*b* and a local bending force is not applied to the sheet, resulting in that the stencil sheet 5 may not be damaged.

In addition, after making the perforated plate, the stencil sheet 5 is removed from the pressing plate, ink is fed on the sheet, the sheet is set again at the pressing plate, and paper to be printed is placed on the base seat 4 to perform a printing operation, wherein also during this printing operation, the ribs 12 may form a clearance M between the stencil sheet 5 and the transparent plate 8. With such an arrangement as above, since a middle part of the stencil sheet warped at its part M is continuously projected toward the base seat 4 during this printing operation, this middle part can be positively contacted with the paper to be printed and it becomes possible to prevent a blurred image from being produced.

In addition, the ribs 12 in the aforesaid preferred embodiment may be formed in a rectangular shape as viewed in their section.

Figure 5:
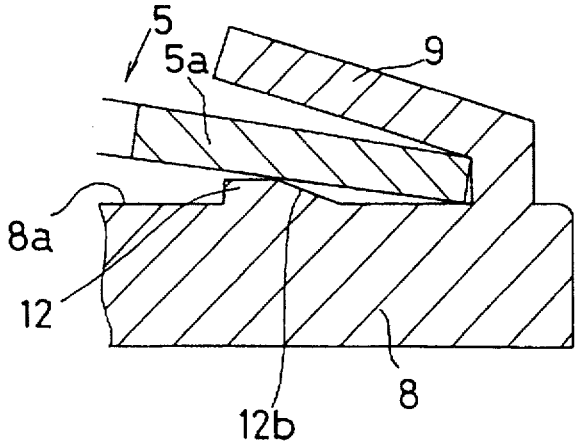
FIG. 5 is a partial sectional view for showing a modification of a rib.

Further, in the case that the ribs 12 are arranged just below the side guides 9, the side guides 9 are inclined to have a predetermined angle toward the central part of the transparent plate 8 as shown in FIG. 5.

With such an arrangement as above, the stencil sheet 5 is partially inclined by the side guides 9 and the inclined surfaces 12*b* of the ribs 12 as shown in the figure and the sheet can be warped entirely like a pot-belly shape in the same manner as that shown in FIG. 4.

Then, setting or removing structure of the light radiating device 3 against the pressing plate 2 will be described.

Figure 6:
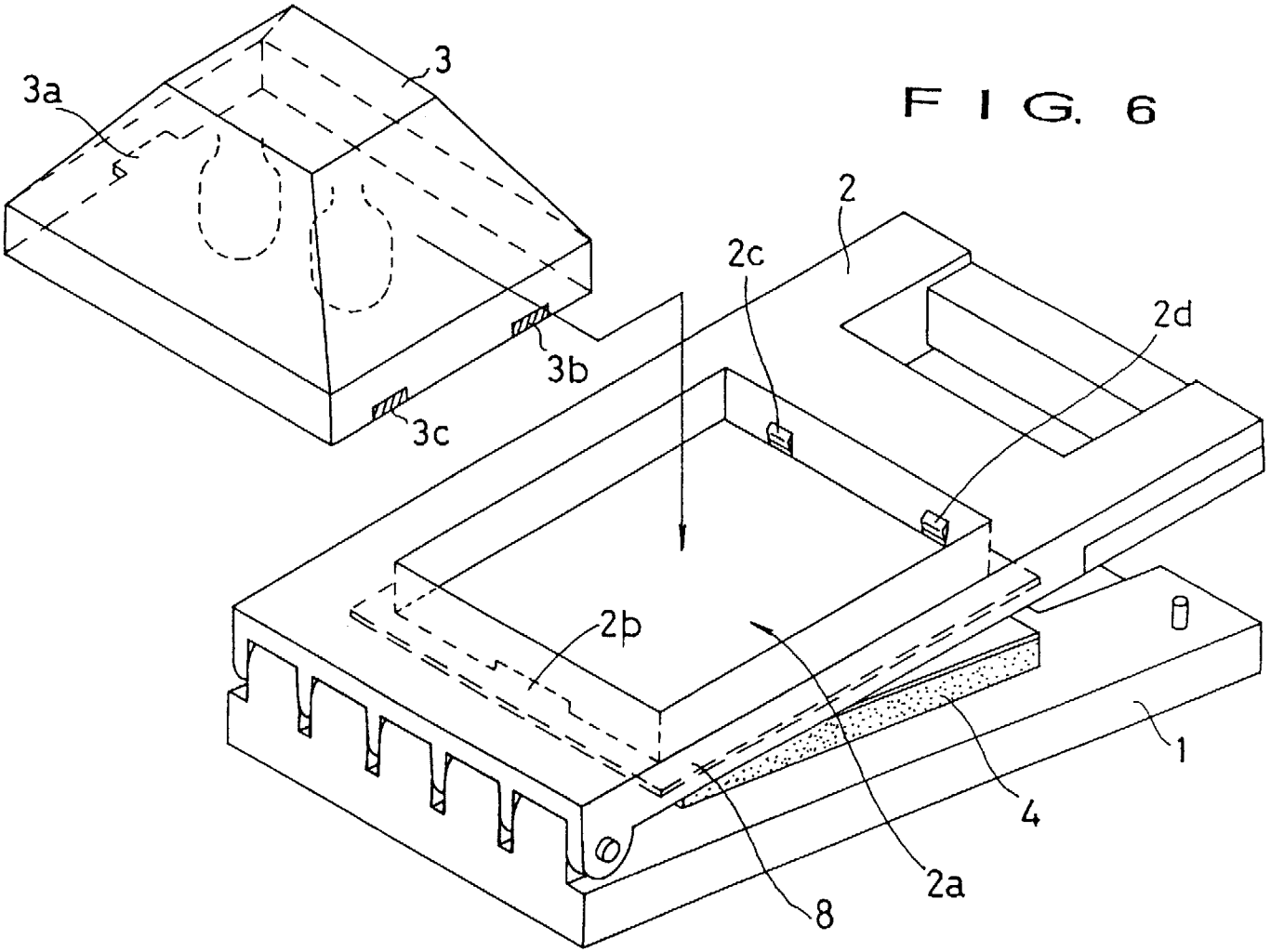
FIG. 6 is a perspective view for showing a setting or a removing configuration of a light radiating device.

As shown in FIG. 6, an opening 2*a* is formed at the upper surface of the pressing plate 2 corresponding to the transparent plate 8, and the light radiating device 3 having its corresponding shape is removably installed at the opening 2*a*.

A mounting piece 3*a* is formed to project at one end part of the light radiating device 3 and the other end of the light radiating device is provided with electrical conducting contact points 3*b* and 3*c*.

The pressing plate 2 is formed with a mounting hole 2*b* corresponding to the mounting piece 3*a*, and the other end of the opening 2*a* is provided with contact points 2*c*, 2*d* to contact with the contact points 3*b*, 3*c*, respectively.

Then, the light radiating device 3 is installed at the opening 2*a* while the mounting piece 3*a* is being engaged with the mounting hole 2*b*.

Upon installed, the light radiating device 3 is connected electrically through contact points 3*b*, 3*c*, 2*c* and 2*d* to a power supply such as a battery cell or the like stored in the pressing plate 2, and the light source such as flash bulbs or the like becomes a state in which light can be emitted.

Then, at a central position of the stopper guide 10 is arranged an installing state releasing means 20.

This installing state releasing means 20 enables the light radiating device 3 to be installed at the pressing plate 2 only when the stencil sheet 5 is set at its specified position in the side guides 9 of the pressing plate 2.

Figure 7:
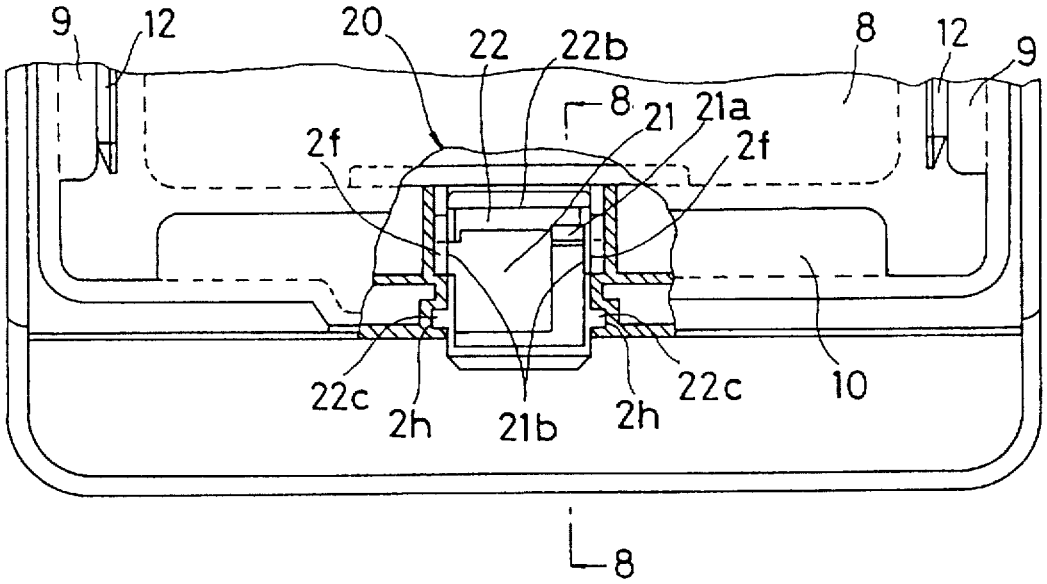
FIG. 7 is a front elevation view partly broken away for showing a releasing means when installed.
Figure 8:
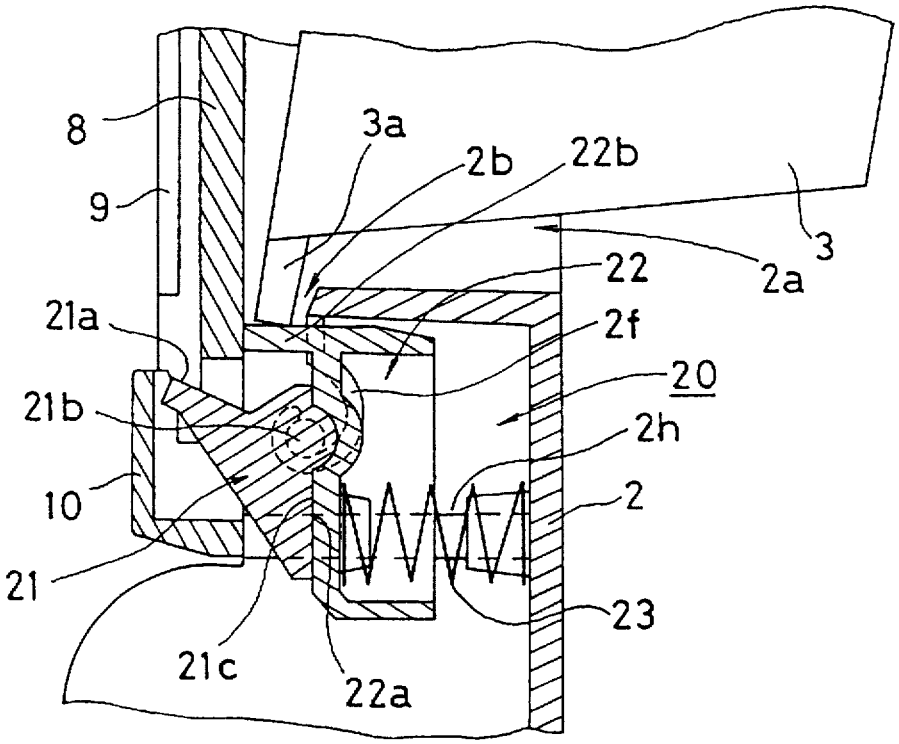
FIG. 8 is a sectional view taken along a line 8—8 of FIG. 7.

FIG. 7 is a front elevation view partly broken away to show the installing state releasing means 20 and FIG. 8 is a sectional view taken along a line 8—8 in FIG. 7.

Between the transparent plate 8 and the stopper guide 10 is projected a contact piece 21*a* of a turning lever 21, wherein the turning lever 21 is pivotaly supported at its shaft 21*b* to a supporting part 2*f* of the pressing plate 2.

This turning lever 21 is provided with a connecting surface 21*c* on a position where it passes through the shaft 21*b*. The connecting surface 21*c* forms a predetermined angle with the contacting piece 21*a* around the shaft 21*b* and it is contacted with an abutting surface 22*a* of the stopper member 22.

The stopper member 22 is provided with a stopper piece 22*b* having a predetermined width at its upper part, and slide projections 22*c* at both sides are freely fitted in the linear grooves 2*h* formed in the pressing plate 2.

The stopper member 22 can be slid along the linear grooves 2*h* and always urged toward the turning lever 21 by a spring 23 inserted between it and the pressing plate 2.

Then, as shown in FIG. 8, under a state in which the stencil sheet is not set on the transparent plate 8, it is stopped under a state in which the abutting surface 22*a* of the stopper member 22 is abutted against the entire surface of the connecting surface 21*c* of the turning lever 21, and the stopper piece 22*b* of the stopper member 22 closes the mounting hole 2*b*.

Under this state, since the mounting piece 3*a* of the light radiating device 3 can not be inserted into the mounting hole 2*b*, the light radiating device 3 can not be installed at the opening 2*a* of the pressing plate 2.

As described above, the installing state releasing means 20 prohibits a setting of the light radiating device 3 in respect to the pressing plate 2 under a state in which the stencil sheet 5 is not set in the pressing plate 2 so as to prevent the perforated plate from being made, resulting in that an erroneous perforating of the stencil sheet can be prevented. With such an arrangement as above, making of the perforated sheet with the light radiating device 3 under a state having no setting of stencil sheet 5 at the pressing plate 2 is prohibited, so that a disadvantage that the original image is adhered by heat directly to the plane 8*a* of the transparent plate 8 can be prevented in advance.

Figure 9:
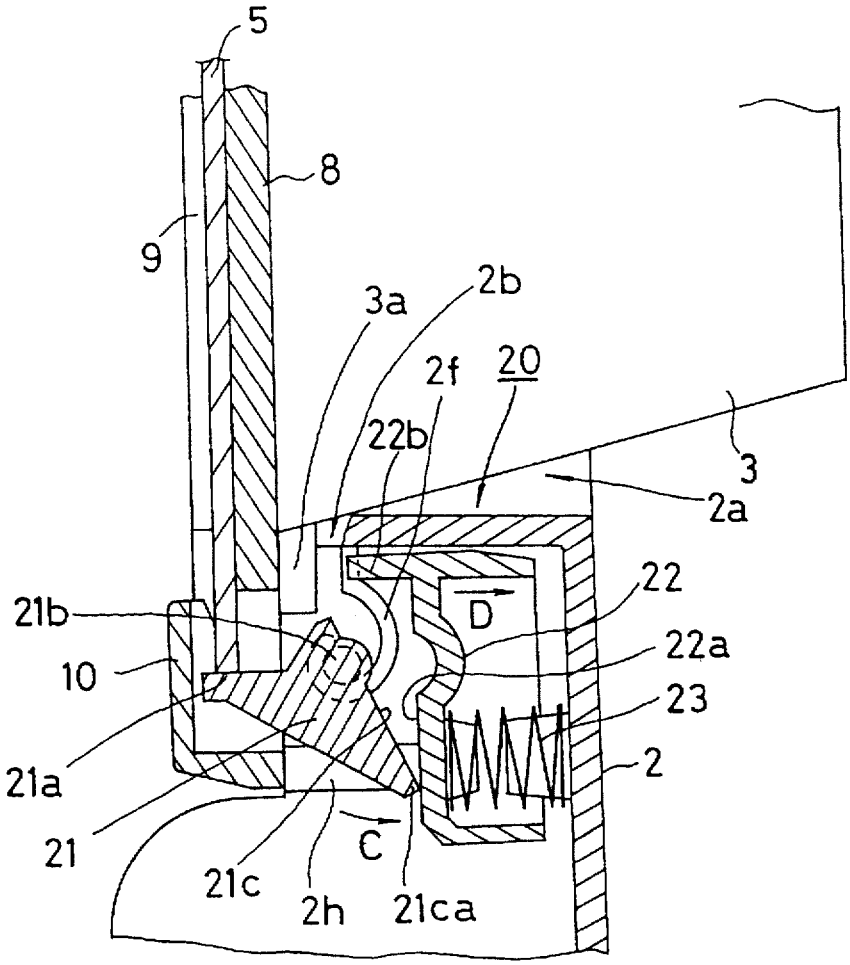
FIG. 9 is a sectional view for showing a releasing operation of the releasing means when installed.
Figure 10:
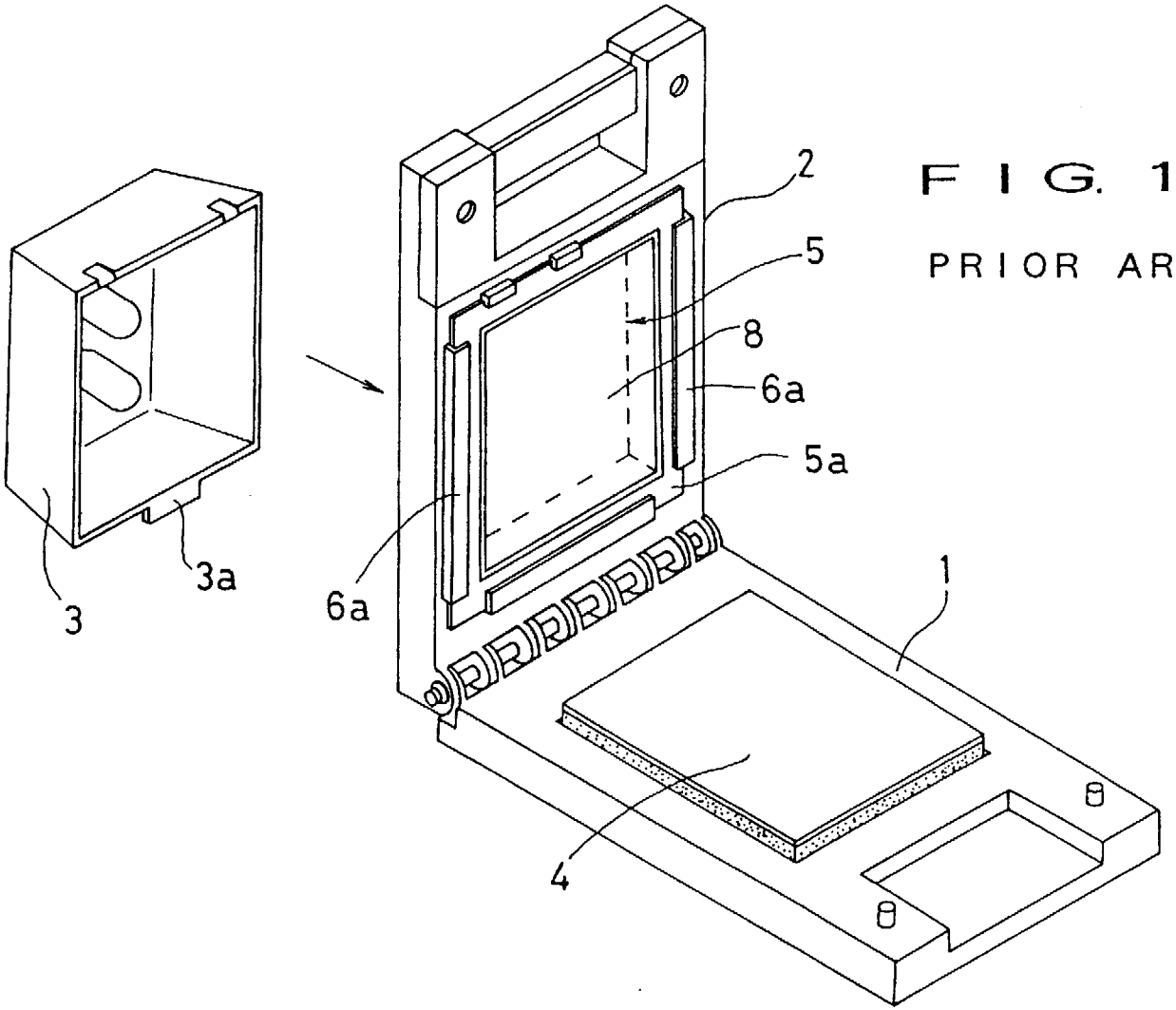
FIG. 10 PRIOR ART
FIG. 10 is a perspective view for showing a stencil printing apparatus.

In turn, as shown in the operational block diagram of FIG. 9, when the stencil sheet 5 is set on the transparent plate 8, the extremity end of the stencil sheet 5 is contacted with the contact piece 21*a* of the turning lever 21 of the installing state releasing means 20 and presses it down.

Then, the turning lever 21 is rotated in the direction C as viewed in the figure around the shaft part 21*b* and the end part 21*ca* of the connecting surface 21*c* pushes against the abutting surface 22*a* of the stopper member resulting in that the stopper member 22 is slid in the direction D as viewed in the figure against an urging force of the spring 23.

Accordingly, a stopper piece 22*b* of the stopper member 22 is retracted from the mounting hole 2*b* and the mounting hole 2*b* is opened.

Under this state, the mounting piece 3*a* of the light radiating device 3 can be inserted into the mounting hole 2*b* and the light radiating device 3 can be installed at the pressing plate 2.

In this way, the installing state releasing means 20 allows the light radiating device 3 to be installed against the pressing plate 2 in response to the fact that the stencil sheet 5 is already in the pressing plate 2 and then the perforation of the stencil plate can be performed.

Upon completion of printing after making of the perforated plate and upon removal of the stencil sheet 5 from the transparent plate 8 after removal of the light radiating means 3, the installing state releasing means 20 returns back to the state shown in FIG. 8 by an urging force of the spring 23, wherein the stopper piece 22*b* of the stopper member 22 closes the mounting hole 2*b* so as to prohibit a setting of the light radiating means 3.

This installing state releasing means 20 is constructed such that it is arranged inside the stopper guide 10 and it can not be directly touched with a hand and further it can be operated only through its contact with the stencil sheet 5, resulting in that its erroneous operation or improper use can be prevented.

In addition, in the case that this installing state releasing means 20 is placed in the device in which the stencil sheet 5 is slid along the surface of the transparent plate 8 to set, it is preferable that it is installed at a downstream side rather than an upstream side inserting direction, in particular, at the front end as found in the aforesaid preferred embodiment.

If it is placed at the downstream side, there is no possibility that the installing state releasing means 20 is released under a condition in which the installing of the stencil sheet 5 is incompletely carried out.

In addition, in the case that the stencil sheet 5 is fixed on the transparent plate 8, the spring 23 pushes the end part 21*ca* of the turning lever 21 through the stopper member 22. In this way, the turning lever 21 is urged in such a direction that the contact piece 21*a* pushes the extremity end of the stencil sheet 5. Thus, the stencil sheet 5 fixed on the transparent plate 8 is pushed toward the holding guides 11 at its rear end, so that it is held more positively on the transparent plate 8 as compared with that of its holding only with the side guides 9 or the ribs 12 and the like.

In the aforesaid preferred embodiment, although the configuration in which the stencil sheet 5 is inserted from a longitudinal direction of the device has been described in reference to a vertical-type device, similar actions and effects may also be attained for a lateral-type device. In the lateral-type device, the mounting means 9 which are continuous in opposition to the lateral direction are provided and the stencil sheet 5 is set from this lateral direction.

In the case of the device in which a sheet is set from a lateral direction, the installing state releasing means 20 is arranged at a lateral position. However, even if the installing state releasing means 20 is placed in a lateral direction, a similar installing or releasing operation can be carried out.

According to the stencil printing device of the present invention, the supporting means for supporting the peripheral part of the stencil sheet while being projected from a plane facing the base is installed near the mounting means for mounting the stencil sheet, so that when the stencil sheet is projected by a predetermined amount toward the base and the pressing plate is turned toward the base during perforating operation and printing operation, the stencil sheet can be positively contacted with either the original or an item to be printed on the base seat at its entire surface.

According to the invention, although the stencil sheet which can be set or removed is slid on the pressing plate along the mounting means, the stencil sheet can be set or removed while the sheet is warped and is forming a predetermined clearance between itself and the pressing plate due to the fact that the supporting means are projected and arranged at the sides of the mounting means, and further this pressing plate may not be damaged. Accordingly, a perforating operation can be performed well without forming scratches or damages on the pressing plate.

In addition, if the supporting means is formed with inclined surfaces of a predetermined angle facing the mounting means, the entire stencil sheet can be warped like a pot-belly shape along the inclined surfaces ranging from the mounting means to the inside portion, a local bending force is not applied to the stencil sheet, the sheet may not be damaged and its central portion can be spaced apart positively from the pressing a plate.

What is claimed is:

1. A stencil printing apparatus comprising:

a base on which an original is set during a perforating operation and an item to be printed is set during a printing operation;

a pressing member pivotally attached to one end of said base and having mounting means adapted to mount a stencil sheet on a plane facing said base; and supporting means arranged to project from the plane of said pressing member and adapted to support a part of peripheral edges of said stencil sheet engaging said mounting means, said supporting means being arranged along said mounting means to allow a center area of said stencil sheet to project toward the base when the stencil sheet engages said mounting means.

2. A stencil printing apparatus comprising:

a base on which an original is set during a perforating operation and an item to be printed is set during a printing operation;

a pressing member pivotally attached to one end of said base and having a through-pass opening formed therein;

a transparent pressing plate arranged at the opening of said pressing member facing said base;

mounting means arranged at said pressing plate facing said base, and adapted to contact peripheral edges of a stencil sheet facing said base to engage said stencil sheet; and supporting means placed at a position inside said mounting means and adapted to be situated outside a printable region of said stencil sheet engaging said mounting means in said pressing plate facing said base, said supporting means being arranged along said mounting means to allow a center area of said stencil sheet to project toward the base when the stencil sheet engages said mounting means.

3. A stencil printing apparatus as set forth in claim 2 in which said mounting means are formed along a setting direction for said stencil sheet.

4. A stencil printing apparatus as set forth in claim 3 in which said mounting means has two sides parallel to the setting direction for said stencil sheet.

5. A stencil printing apparatus as set forth in claim 2 in which said supporting means are projections formed along a setting direction for said stencil sheet.

6. A stencil printing apparatus as set forth in claim 5 in which said supporting means have inclined surfaces of a predetermined angle at sides facing said mounting means.

7. A stencil printing apparatus as set forth in claim 5 in which both ends of said supporting means are gradually reduced in height toward said pressing plate.

8. A stencil printing apparatus as set forth in claim 2 in which a space from a contact position between said supporting means and said stencil sheet to a contact position between said mounting means and said stencil sheet is set to be at least substantially equal to a thickness of said stencil sheet.

9. A stencil printing apparatus as set forth in claim 2, further comprising installing state releasing means attached to the pressing member, said installing state releasing means including a turning lever rotatably attached to the pressing member, a stopper member situated in the pressing member to be slidable relative to the turning lever, and a spring for urging the stopper member toward the turning lever.

* * * * *